US006662728B2

(12) United States Patent
Theurer et al.

(10) Patent No.: US 6,662,728 B2
(45) Date of Patent: Dec. 16, 2003

(54) MACHINE AND METHOD FOR TREATING A TRACK

(75) Inventors: Josef Theurer, Vienna (AT); Bernhard Lichtberger, Leonding (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/213,132

(22) Filed: Aug. 6, 2002

(65) Prior Publication Data

US 2003/0029350 A1 Feb. 13, 2003

(30) Foreign Application Priority Data

Aug. 9, 2001 (AT) ..... 1249/2001

(51) Int. Cl.[7] ..... E01B 29/02
(52) U.S. Cl. ..... 104/2
(58) Field of Search ..... 104/2, 5, 6, 9, 104/10

(56) References Cited

U.S. PATENT DOCUMENTS 3,762,333 A * 10/1973 Theurer et al. ..... 104/12
3,942,000 A 3/1976 Dieringer
5,671,679 A 9/1997 Straub et al.

FOREIGN PATENT DOCUMENTS

AT 321 347 3/1975
JP 322707/94 A 11/1994

* cited by examiner

*Primary Examiner*—S. Joseph Morano
*Assistant Examiner*—Robert J. McCarry, Jr.
(74) *Attorney, Agent, or Firm*—Henry M. Feiereisen

(57) ABSTRACT

For detecting a tie position in a track, a non-contact scanning device on a track-bound machine is associated with an odometer for recording a distance travelled by the machine. The scanning device is configured as distance measuring device for registering vertical distance measurement values between the machine and track, and is operatively connected to a control unit. The control unit is designed for continually and sequentially subdividing a measuring span, correlated to the distance travelled, into a succession of tie detection sections and adjacent ballast detection sections, which are associated with a ballast region situated between the ties. The tie detection section includes distance measurement values differing only slightly from one another, while the ballast detection section contains a sequence of abruptly fluctuating distance measurement values. As a result of detecting the tie position, a working unit, such as a tamping unit, can be centered over the tie automatically.

8 Claims, 2 Drawing Sheets

MACHINE AND METHOD FOR TREATING A TRACK

CROSS-REFERENCES TO RELATED APPLICATIONS

This application claims the priority of Austrian patent application No. A 1249/2001, filed Aug. 9, 2001, the subject matter of which is incorporated herein by reference.

BACKGROUND OF THE INVENTION

The present invention relates, in general, to a machine for treating a track extending in a longitudinal direction and comprised of two rails fastened to ties supported on ballast, and more particularly to a machine mounted for mobility on the track and comprising a working device operable cyclically for carrying out work on the track; an odometer for registering a distance travelled by the machine along the track; a non-contact scanning device, associated with the odometer, for detecting a position of a tie; and a control unit for centering the working device in dependence upon the scanned tie position. The invention also relates to a method of treating a track.

A machine of this kind, designed as a track tamping machine, is already known from U.S. Pat. No. 3,762,333. The machine includes a working device in the shape of a tamping unit. In front of the latter, with regard to the operating direction of the machine, a scanning device designed as a pulsor is mounted on a frame of the machine in the region of rail fastening means of the track. The scanning device is designed to respond to the proximity of metallic objects, for example a rail bolt, and to emit a corresponding signal. The distance covered by the machine is registered by means of an odometer. Subsequently, taking into account the known distance between the pulsor and the tamping unit, the machine is stopped with the aid of a control unit in such a way that the tamping unit is centered exactly above a tie which is to be tamped.

Austrian Pat. No. AT 321 347 discloses a machine having an electron-optical control element in the shape of a television camera, enabling an operator to precisely adjust the tamping unit individually to the position of the respective tie to be tamped.

U.S. Pat. No. 5,671,679 shows the use of different kinds of sensors by means of which the position of a tie plate or of a similar target object can be detected and registered in a non-contact manner.

Finally, according to Japanese Pat. No. JP 322707/94 A, it is known to detect the difference between a tie surface and a ballast surface by means of an image processing device formed by a light slot and a camera, and to correspondingly control the lowering of tamping units of a track tamping machine during operation.

It would be desirable and advantageous to provide an improved machine of the afore-described type, and a method, which makes it possible to detect the position of a tie in the track in a reliable and dependable way.

SUMMARY OF THE INVENTION

According to one aspect of the present invention, a machine for treating a track is mounted for mobility on the track and includes a working device operable cyclically for carrying out work on the track; an odometer for registering a distance travelled by the machine along the track; a non-contact scanning device, associated with the odometer, for detecting a position of a tie, the scanning device being mounted on the machine above the track and designed as a distance measuring device for registering in a non-contact manner vertical distance measurement values between the scanning device and a tie or ballast surface of the track; and a control unit for centering the working device in dependence upon the scanned tie position, the control unit being connected to the distance measuring device and designed for continuously and sequentially subdividing a measuring span, correlated to the distance travelled, into tie detection sections alternating with ballast detection sections, wherein each tie detection section comprises distance measurement values differing only slightly from one another, while the adjoining ballast detection section is characterized by a sequence of abruptly fluctuating distance measurement values.

A machine designed in this way allows to unfailingly detect and register the position of track ties in a most reliable fashion. An important special, advantage is due to the fact that said detection of the tie position can be accomplished safely regardless of which type of tie is present in the track at any given location. As a result, it is possible to scan and treat without problems even older tracks which may have undergone repeated maintenance cycles including tie renewal, and which therefore may include different types or sizes of ties and/or rail fastenings.

According to another feature of the invention, two distance measuring devices are provided, spaced from one another transversely of the longitudinal direction, each being associated with a separate testing unit. This has the advantage that it is thereby possible to detect even a slanted position of a tie lying askew in the track, and to correspondingly adjust the working device before operation in order to prevent possible damage to the working device or to the track.

The present invention also relates to a method of treating a track extending in a longitudinal direction and comprised of rails fastened to ties supported on ballast, with a machine mobile on the track and having a working device operable cyclically, wherein the distance travelled by the machine on the track is measured during an advance movement of the machine, and the position of ties is scanned in a non-contact manner, the method comprising the steps of continuously obtaining distance measurement values, extending in a vertical direction between the machine and a tie or ballast surface, along a measuring line extending in the longitudinal direction across ties and ballast; storing the distance measurement values and establishing therefrom a measuring curve correlated to the distance travelled; and subdividing the measuring curve into an alternating sequence of tie detection sections comprising distance measurement values varying only slightly, and ballast detection sections comprising a succession of abruptly fluctuating distance measurement values, wherein the beginning of each tie detection section is associated with a first transition point of the measuring curve, and the beginning of each ballast detection section is associated with a second transition point of the measuring curve.

This method provides a sure and reliable way of detecting the position of ties in a track regardless of the type or size of the tie.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
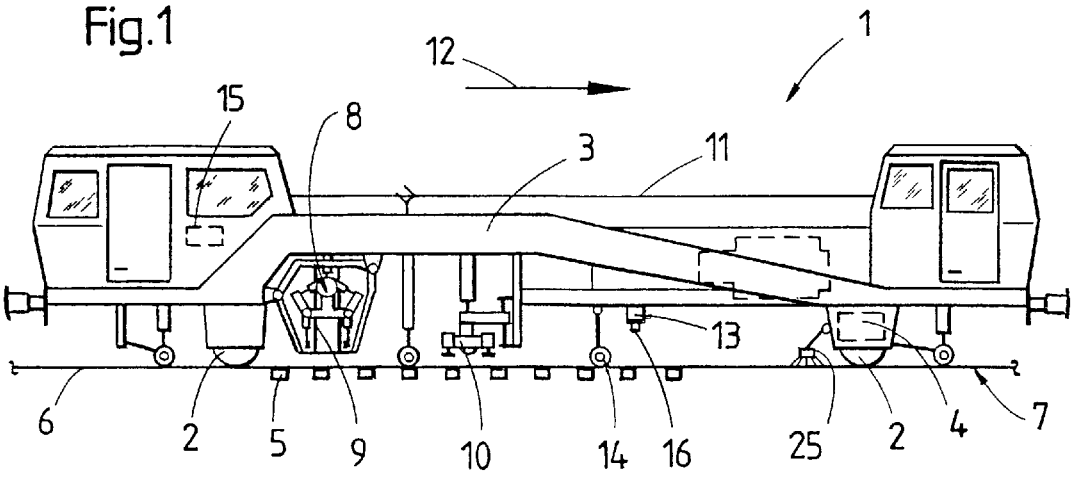
FIG. 1 is a simplified side elevational view of a machine according to the present invention, having a cyclically operable working device for treating a track.

Throughout all the Figures, same or corresponding elements are generally indicated by same reference numerals.

Turning now to the drawing, and in particular to FIG. 1, there is shown a machine 1 having a machine frame 3 supported on undercarriages 2. A motive drive 4 is provided for mobility of the machine 1 on a track 7 which is composed of rails 6 fastened to ties 5 and extends in a longitudinal direction. A working device 8 for treating the track 7 is arranged on the machine frame 3 between the undercarriages 2 and has the shape of a tamping unit 9 designed for cyclic operation. A track lifting unit 10 as well as a reference system 11 are associated with the tamping unit 9. The operating direction of the machine 1 is indicated by an arrow 12.

Located in front of the working device 8, with regard to the operating direction, are two scanning devices 13 for detecting a position of a tie 5 in the track 7. The two scanning devices 13 are spaced from one another transversely of the longitudinal direction and mounted on opposite sides of the machine frame 3. An odometer 14 designed for rolling on the rail 6 is provided for measuring the distance travelled by the machine 1 on the track 7. The two scanning devices 13 as well as the odometer 14 are connected to a control unit 15 arranged in an operator's cabin of the machine.

Figure 2:
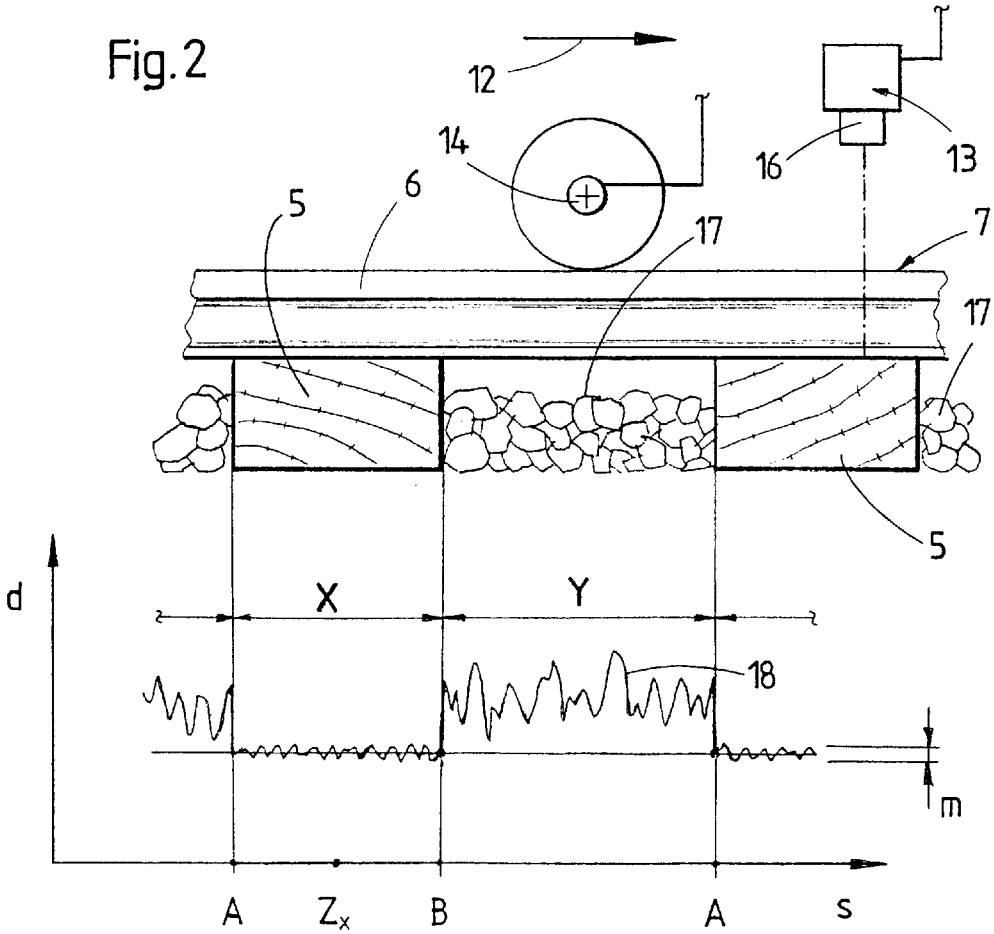
FIG. 2 is a schematic illustration of a scanning device with a measuring curve.

As can be seen in FIG. 2, each scanning device 13 is designed as a distance measuring device 16, operating in a non-contact manner, for measuring the vertical distance between the scanning device 13 and a tie 5, lying thereunder, or the surface of ballast 17 present between the ties 5. As the machine 1 moves forward in the operating direction (arrow 12), the scanning device 16 carries out a multitude of measurements, resulting in a multitude of distance measurement values d which are registered in dependence upon the distance s travelled by the machine 1 as recorded by the odometer 14. The product of all the distance measurement values d is a measuring curve 18.

The measuring curve 18 is composed of an alternating sequence of tie detection sections X followed in each case by a ballast detection section Y. Each tie detection section X comprises distance measurement values d which differ only slightly from one another, while each ballast detection section Y consists of a multitude of abruptly fluctuating distance measurement values d. The beginning and end of a tie detection section X can be readily identified as they correlate to a transition point A or B, respectively, of the measuring curve 18. A centering point Zx is found by dividing the tie detection section X in half, said centering point being used for centering, in a time-delayed way, the tamping unit 9 above a corresponding tie 5.

The maximal distance measurement values d of the tie detection section X located between the two transition points A and B do not exceed a minimal band width m, while the maximal distance measurement values d defining the ballast detection section Y range distinctly beyond the limits indicated by the minimal band width m.

Figure 3:
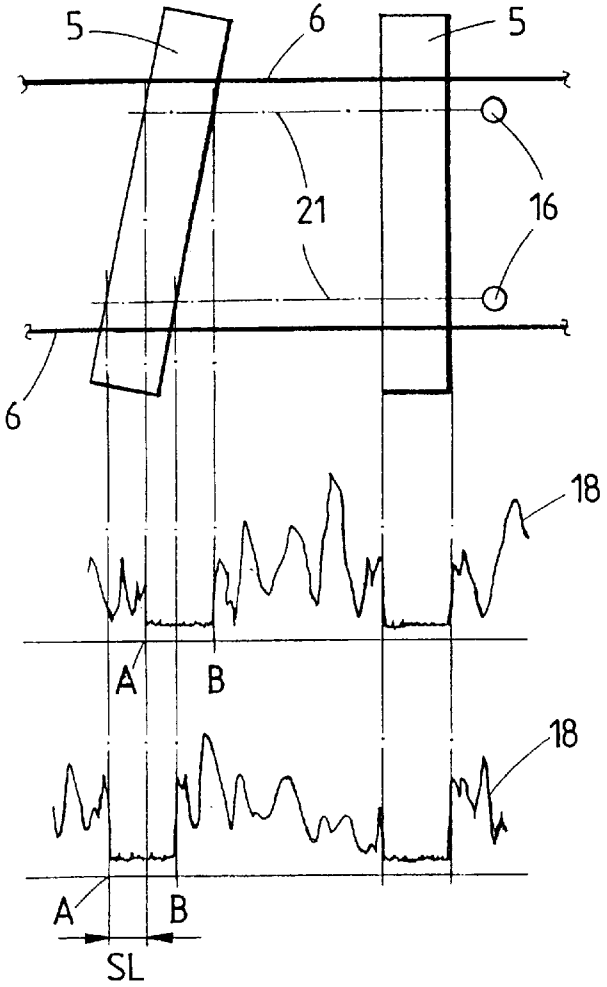
FIG. 3 is a schematic top view of a track, with two scanning devices and corresponding measuring curves.

As shown in FIG. 3, each of the two distance measuring devices 16 is associated with a separate measuring line 21, extending in the longitudinal direction, along which the tie position is scanned during an operational forward movement of the machine 1. With this arrangement, it is possible to form two measuring curves 18 independent of one another, thus allowing the detection of a slanted position SL of a tie 5 in the track 7 as indicated by a displaced transition point A, for example. As a result, the two following tamping units 9 (not shown) can be optimally centered in each case and independently of each other above the respective tie portion before initiating the tamping operation.

Figure 4:
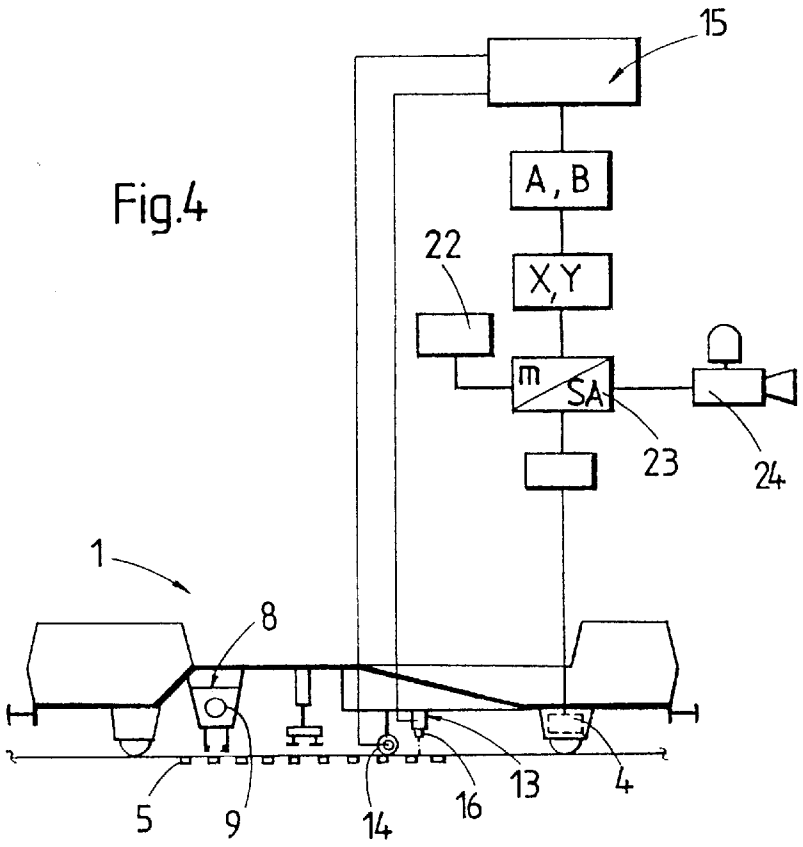
FIG. 4 is a schematic illustration of components of the machine.

As shown schematically in FIG. 4, the control unit 15 is connected to the distance measuring device 16 and to the odometer 14 for correlating the measuring curve 18 to the distance travelled by the machine 1. With registration of transition points A and B, the measuring curve 18 formed by a multitude of distance measurement values d is now subdivided in the control unit 15 into a sequence of tie detection sections X alternating with ballast detection sections Y. This is accomplished, for instance, by filtering out only those measurement values d which lie within a minimal band width m.

Threshold values for defining the minimal band width m, as well as a minimal and maximal width of ties 5 which could possibly be present in the track 7, can be entered into an input unit 22 in which a tie acceptance range SA is then defined. A testing unit 23 is provided for carrying out a plausibility check of the previously determined tie detection section X in order to ascertain whether the tie width defined by the two transition points A and B lies within the threshold values stored in the input unit 22. If this check proves negative, an acoustical and/or optical warning device 24 is activated in order to alert an operator to the unclear situation.

If the check produces a positive result, the centering point Zx is determined by dividing in half the distance travelled between the transition points A and B. This information is then stored and put out in a delayed manner for automatically stopping the forward motion of the machine 1 in order to ultimately center the tamping units 9 above the respective tie 5 to be tamped.

By computing the mean tie width and the mean tie distance or spacing, it is also possible to detect and indicate the presence of double ties. By comparing the computed forward motion to the actually measured forward motion, a correction value is computed automatically which, during the computation of the desired values for the forward motion, takes into account the varying conditions prevailing during working operation (friction value rail/wheel). The possibility of shifting the braking point of the machine 1 and the pre-signal by means of digital adjustment also enables the operator to manually correct the centering of the working device 8. Ballast 17 which may be present in the region of the measuring lines 21 can be removed with the aid of a vertically adjustable sweeping device 25 (FIG. 1).

While the invention has been illustrated and described as embodied in a machine for treating a track, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. A machine for treating a track extending in a longitudinal direction and comprised of two rails fastened to ties supported on ballast, the machine being mounted for mobility on the track and comprising:

a) a working device constructed to operate cyclically for carrying out work on the track;

b) an odometer for registering a distance travelled by the machine along the track;

c) a non-contact scanning device, operatively connected to the odometer, for detecting a position of a tie, the scanning device being mounted on the machine above the track and designed as a distance measuring device for registering in a non-contact manner vertical distance measurement values between the scanning device and a tie or ballast surface of the track; and d) a control unit for centering the working device in dependence upon the scanned tie position, the control unit being connected to the distance measuring device and designed for continuously and sequentially subdividing a measuring span, correlated to the distance travelled, into tie detection sections alternating with ballast detection sections, wherein each tie detection section comprises distance measurement values differing only slightly from one another, while the adjoining ballast detection section is characterized by a sequence of abruptly fluctuating distance measurement values.

2. The machine of claim 1, and further comprising two distance measuring devices, spaced from one another transversely of the longitudinal direction, and two testing units operatively connected to the distance measuring devices, whereby the distance measuring devices and the testing units are placed into one-to-one correspondence.

3. A method of treating a track extending in a longitudinal direction and comprised of rails fastened to ties supported on ballast, with a machine mobile on the track and having a working device operable cyclically, wherein the distance travelled by the machine on the track is measured during an advance movement of the machine, and the position of ties is scanned in a non-contact manner, said method comprising the steps of:

a) continuously obtaining distance measurement values, extending in a vertical direction between the machine and a tie or ballast surface, along a measuring line extending in the longitudinal direction across ties and ballast;

b) storing the distance measurement values and establishing therefrom a measuring curve correlated to the distance travelled; and c) subdividing the measuring curve into an alternating sequence of tie detection sections comprising distance measurement values varying only slightly, and ballast detection sections comprising a succession of abruptly fluctuating distance measurement values, wherein the beginning of each tie detection section is associated with a first transition point of the measuring curve, and the beginning of each ballast detection section is associated with a second transition point of the measuring curve.

4. The method of claim 3, wherein minimal and maximal distance measurement values defining the tie detection section are storeable for defining a minimal band width.

5. The method of claim 4, wherein the maximal distance measurement values associated with the ballast detection section lie outside the range of the minimal band width.

6. The method of claim 3, wherein the distance between the first and the second transition point, defining a tie detection section, is compared in the course of a continual plausibility check to a tie acceptance range correlating to tie width, the tie acceptance range being stored in a control unit and comprising various tie widths of different types of ties possibly occurring in the track.

7. The method of claim 6, and further comprising at least one of an optical and acoustical warning device which is activated as soon as the plausibility check of a tie detection section yields a result lying outside the stored tie acceptance range.

8. The method of claim 3, wherein a region of a tie situated in the measuring line is swept clean before the position of the tie is scanned.

* * * * *